US006327942B1

(12) United States Patent
Mariol et al.

(10) Patent No.: US 6,327,942 B1
(45) Date of Patent: Dec. 11, 2001

(54) MULTIPLE BIT DRIVER

(75) Inventors: James Felix Mariol; Howard Nicholas Ragland, both of Cincinnati, OH (US)

(73) Assignee: Lutz File & Tool Company, Cincinnati, OH (US)

( * ) Notice: Subject to any disclaimer, the term of this patent is extended or adjusted under 35 U.S.C. 154(b) by 0 days.

(21) Appl. No.: 09/636,431

(22) Filed: Aug. 10, 2000

(51) Int. Cl.[7] ..... B25B 23/16
(52) U.S. Cl. ..... 81/177.4; 81/490; 81/438
(58) Field of Search ..... 81/490, 492, 437–439, 81/177.4

(56) References Cited

U.S. PATENT DOCUMENTS

| | | | |
|---|---|---|---|
| D. 358,316 | | 5/1995 | Markwart et al. . |
| 463,507 | | 11/1891 | Goodell . |
| 4,241,773 | | 12/1980 | Personnat . |
| 4,552,044 | | 11/1985 | Corona et al. . |
| 4,716,796 | | 1/1988 | Corona et al. . |
| 4,924,733 | | 5/1990 | McKenzie . |
| 5,174,178 | | 12/1992 | Disston, Jr. . |
| 5,228,363 | | 7/1993 | Corona et al. . |
| 5,638,727 | | 6/1997 | Gringer . |
| 5,740,706 | | 4/1998 | Tseng . |
| 5,799,552 | | 9/1998 | Curtis . |
| 5,881,615 | | 3/1999 | Dahl et al. . |
| 5,894,765 | | 4/1999 | Anderson et al. . |
| 5,947,212 | * | 9/1999 | Huang ..... 81/490 X |
| 6,029,549 | | 2/2000 | Baker . |
| 6,032,332 | | 3/2000 | Lin . |
| 6,220,129 | * | 4/2001 | Shimansky ..... 81/177.4 X |
| 6,237,451 | * | 5/2001 | Wei ..... 81/177.4 X |

FOREIGN PATENT DOCUMENTS

0312775A1 9/1988 (GB) .

* cited by examiner

*Primary Examiner*—D. S. Meislin
(74) *Attorney, Agent, or Firm*—Killworth, Gottman, Hagan & Schaeff LLP

(57) ABSTRACT

A driver is provided with storage for interchangeable bits in the handle portion. The handle portion comprises a generally cylindrical driver body, that is aligned along a common longitudinal axis with the shaft. Evenly spaced and outwardly opened grooves span longitudinally along the body for providing channel access to bits, such that one bit is stored in each groove. A bit cap is positioned over the heel end of the driver body and extends at least partially along the length of the driver body to form bit storage chambers. Through apertures in the closed end of the bit cap are spaced to align with the corresponding grooves in the handle body, for inserting and removing bits. A bit gate consisting of a circular disk having a single gate aperture is positioned between the heel of the driver body and the bit cap for selection of a desired bit. A bit selector knob extends longitudinally outward from the bit gate, through the back portion of the bit cap. By turning the bit gate, a user can cause the gate aperture in the bit gate to align longitudinally with any one of the grooves in the handle for replacing or removing bits, or alternatively, the gate aperture may be positioned between grooves effectively locking the bits in their respective bit channels.

43 Claims, 3 Drawing Sheets

MULTIPLE BIT DRIVER

BACKGROUND OF THE INVENTION

The present invention relates in general to a hand tool, and in particular to a driver having multiple bit storage in the handle.

Screwdrivers are driving tools useful for tightening and loosening threaded screw type fasteners. The screwdriver generally consists of a handle portion for maintaining a grip, and an integral shank that extends axially from one end of the handle. At the end of the shank distal to the handle, is a formed tip designed to engage the head of a screw or like fastener. However, screw type fasteners are available with many head configurations, such that a user may require several different screwdrivers to fulfill all of his or her fastening needs. This increases overall cost and storage space requirements for owning such tools. Also, workers may be in confined areas, or awkward workplaces, where it may be difficult to maintain or switch between a number of differently configured screwdrivers.

A known type of screwdriver incorporates a socket at the end of the shank which is capable of receiving driving bits with different tip configurations. This allows the same handle and shank to service many different screw and fastener types. However, the driving bits are often small, and susceptible to being misplaced or lost. One solution to this problem is to provide storage for unused bits in the tool itself, for example, a hollowed out portion of the handle. While the handle portion does provide a suitable location for storing unused bits, such tools are often difficult or inconvenient to use. For example, it is sometimes difficult to see or select the desired bit. Further, bits stored in some handles are loose and rattle around inside the tool, or alternatively, are difficult to remove from their storage compartment. Further, some storage compartments detract from the ergonomics of handle design or can weaken the handle. Still other handle storage compartments are difficult to access, open, or secure closed.

SUMMARY OF THE INVENTION

The present invention overcomes the disadvantages of previously known multi-bit screwdrivers wherein a driving tool is provided with bit storage in the handle. The handle portion comprises a generally cylindrical driver body, that is aligned along a common longitudinal axis with the shaft. The handle is comprised generally of a driver body and a bit cap. The bit cap is provided with a plurality of apertures which align with chambers in the driver body for storing driving bits. To lock the bits into place, and to facilitate the selection of bits from their respective storage chambers, a bit gate is provided between the heel of the driver body and the bit cap. The bit gate includes a bit selector nob which is rotatable to unlock the desired bit storage chamber.

In one embodiment, the driver body includes a plurality of bit channels arrayed circumferentially about a longitudinal axis of the body, with each of the plurality of bit channels open at the second, or heel end. A bit cap having a plurality of through apertures aligned with the plurality of bit channels, is positioned over the driver body, covering at least the second end of the driver body. Further, a bit gate for selectively blocking alignment of the plurality of bit channels with the plurality of through apertures is juxtaposed with the heel, or second end of the driver body, and is circumscribed by the bit cap. The bit gate includes a bit selector, for example a knob, accessible through a bit selector access port on the bit cap, and a disk portion capable of interfering with the plurality of bit channels at their respective opening on the second end of the driver body. Preferably, a plurality of bits are insertable, one each into any one of the plurality of bit channels. To facilitate easy selection of bits stored in the handle portion of the tool, the tips of each of the bits stored in the tool are viewable through the driver body.

To facilitate viewing the driving bit tips, the bit cap contains a plurality of tip portals aligned such that the tips of each of the stored bits are viewable through the bit cap. The tip portals can be either integral with, or separate from, the through apertures for providing ingress and egress for the bits. Further, where driving bits are utilized which incorporate a unique tip configuration on each end of the shaft of the bit, tip viewing portals can be included along the driver body to expose a portion of the bit channel proximate the nose end of the tool.

Optionally, to ensure positive engagement of the bit cap with the driver body, the body includes a plurality of splines which protrude from its surface. The bit cap further comprises a plurality of spline channels for receiving the splines. The splines may be positioned anywhere along the surface of the driver body so long as sufficient strength is achieved. For example, where the bit channels are outwardly open, the splines can be interleaved between the bit channels.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
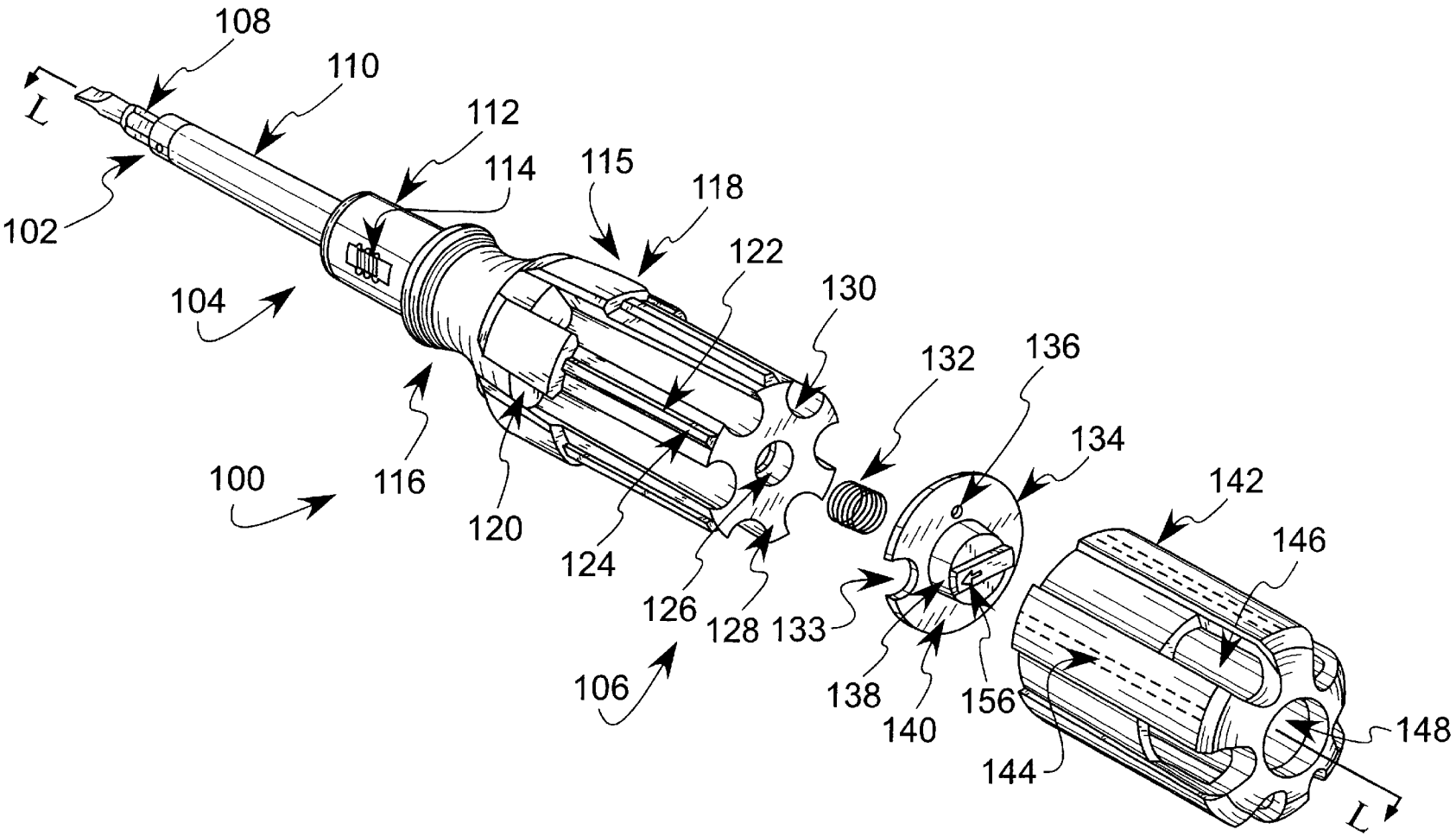
FIG. 1 is an isometric illustration of the assembly of a driver according to the present invention.
Figure 3:
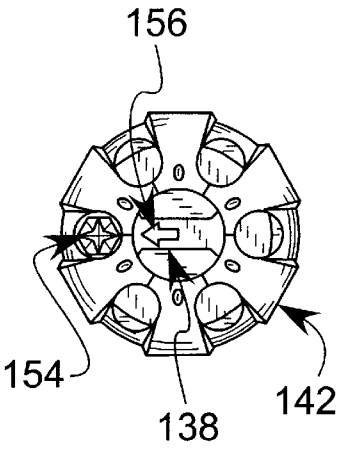
FIG. 3 is an end view of the heel of a driver according to the present invention, illustrating the bit selector knob of the bit gate opening the channel to allow removal of a stored bit.

Referring to FIG. 1, the driving tool 100, is comprised generally of a socket 102 for receiving bits 108 of various configurations. Connected to the socket 102 is a generally elongate shank 104 terminating in a generally cylindrical driver handle 106. The driver handle 106 is aligned along a common longitudinal axis L, with the shank 104. The handle 106 comprises a body portion 115, biasing spring 132, bit gate 134, and a bit cap 142. Depending upon the particular anticipated uses of the driving tool 100, the driving bits 108 can be configured to function with any fastener head configurations including, but not limited to, various sized phillips head, slotted head, hex head or star head. The shank 104 includes a shaft portion 110, and may optionally include a ratcheting device 112. While not required to practice the present invention, ratcheting device 112 includes a switch 114 for selecting the direction of rotation of handle 106 with respect to shank 104. The ratcheting mechanism 112 can utilize a pawl, hinged catch, or alternatively any other arrangement that provides suitable ratcheting functionality. Further, the ratcheting mechanism 112 may be positioned at any point along shaft 110. The driver handle 106 can be comprised of any suitable construction material. For example, a molded plastic of suitable strength will be generally acceptable.

Figure 2:
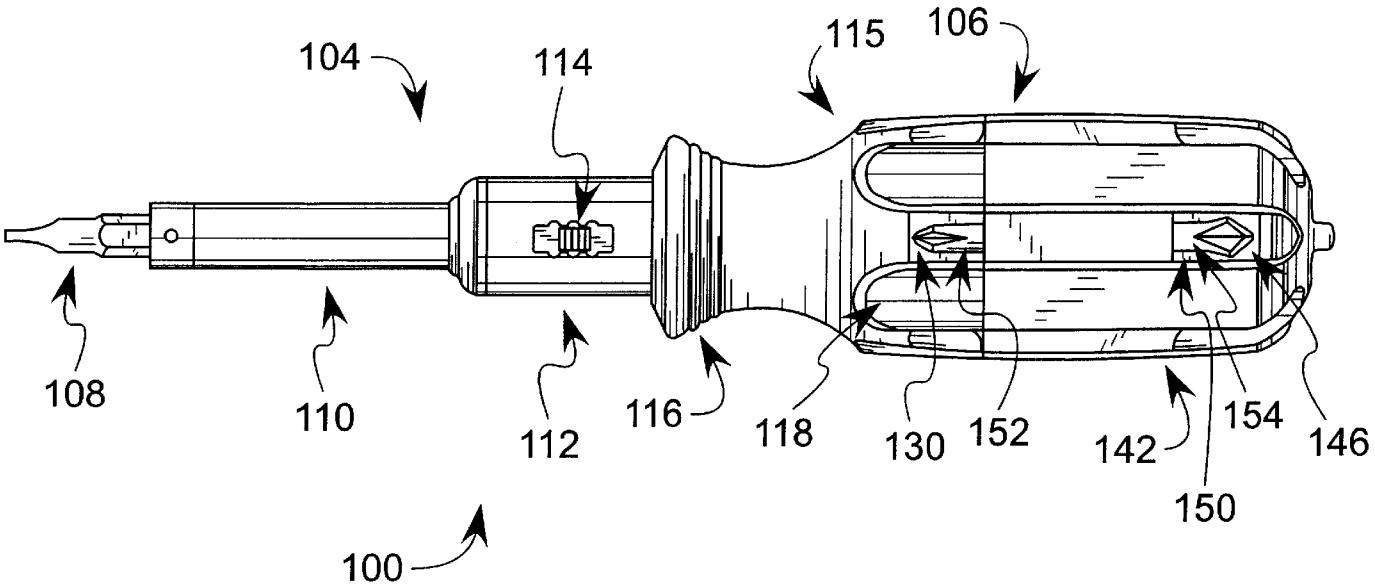
FIG. 2 is a side view illustration of a driver according to the present invention, where a driving bit is stored in a bit channel.

Referring to FIGS. 1 and 2, the driver handle, or driver body 106 includes a generally elongate body portion 115, which is includes a nose, or first end 116, and a heel, or second end 128. The size and geometry of the body portion 115 may vary depending on desired handle length, girth, and other like factors. The body portion 115 includes a plurality of bit channels 130, arrayed circumferentially about a the longitudinal axis L, through body portion 115. The bit channels span generally longitudinally along the body 115 for providing channel access to store unused bits, such that one bit is stored in each bit channel 130. Referring to FIG. 2, it should be appreciated by those skilled in the art that the bit channels 130 may be of any length and geometry without departing from the present invention. However, generally, the bit channels 130 should be at least as long as the length of selected bits 150 such that the bit 150 fits properly inside the driver handle 106. Referring to FIG. 1, while the bit channels 130 are illustrated as evenly spaced and outwardly opened grooves, the bit channels 130 may optionally be implemented as bores extending through the body portion 115. Further, any number of bit channels 130 can be implemented without departing from the present invention. For example, the body portion 115 may be implemented with six bit channels 130. Thus the tool is capable of simultaneously storing six driving bits 150. Further, should the driving bits 150 include tips for receiving a different fastener head type on either end 152, 154 of the bit 150, the driver tool is then capable of 12 different fastening tasks. Including a bit in the socket, 14 driving tasks can be provided for with a single tool.

Bit cap 142, is slid over the body portion 115 in the direction starting from the heel 128 and towards the first portion, or nose 116, such that the knob, or bit selector 138 of the bit gate 134 extends out the back portion of the bit cap 142 through the provided bit selector access port 148. The bit cap 142 extends over and covers at least a portion of the bit channels 130 in the handle portion 115, thus forming enclosed bit storage chambers. The bit cap 142, further includes openings, or through apertures 146 spaced to align with the corresponding bit channels 130 in the body portion 115, and provide a means of ingress and egress into the bit channels 130 for the driving bits 150.

To allow a user to select a desired bit, or, alternatively, to allow a user to lock bits in their respective storage compartments, a bit gate 134 is provided. The bit gate 134 consists of a generally circular disk or bit shield 140 which provides a gating function. The bit shield 140 includes a single through portion, or gate aperture 133 dimensioned and positioned such that cooperation can be achieved between the bit channels 130 and the aperture 133. The gate aperture 133 can accommodate any geometry. For example, the gate aperture can be generally circular and dimensioned such that no more than one bit channel 130 can be in alignment with the gate aperture 133 at any given time. Further, the gate aperture 133 is adjustable such that no bit channel 130 is in substantial alignment with gate aperture 133, and thus no bits can be removed from their respective bit channels 130. The locking of the bit channel 130 is possible because the bit gate 134, and more particularly, the disk portion 140 substantially interferes with the opening of the bit channel 130 at the second end, or heel, 128 of the driver body 115. The bit gate 134 includes a knob, or bit selector 138 which extends longitudinally outward from the heel 128 of the driver body 115. The bit selector 138 provides a convenient manner to select desired bits 150. By rotating the bit selector 138, the gate aperture can be brought into alignment with one of the plurality of bit channels. To ease the task of selecting the desired driving bit 150, a portion of the bit selector 138 can receive indica or other suitable markings 156. For example, bit selector 138 may include a directional arrow, or bit indicator 156 to identify the current position of the gate aperture 133. To assist in aligning the bit gate 134 with a bit channel 130, a signaling mechanism is provided which is capable of providing a visual, audible, or tactile signal to a user. In one embodiment, a detent 136 is provided on the surface of the disk portion 140 of the bit gate 134.

Figure 6:
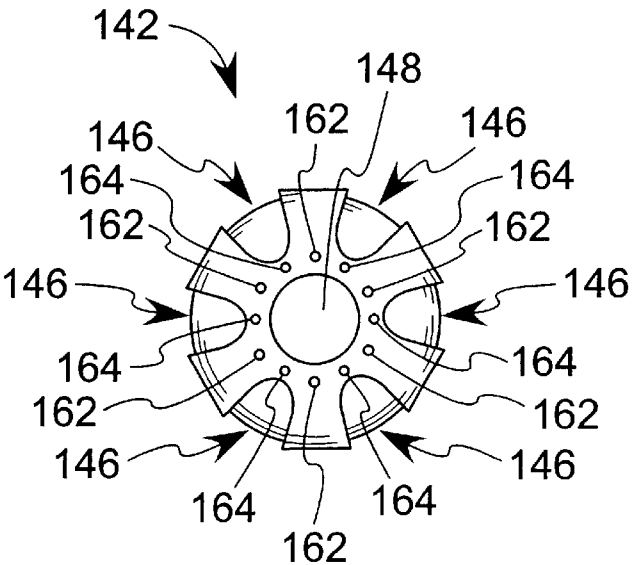
FIG. 6 is an end view of the heel of a driver according to the present invention, illustrating the inside surface of the bit cap, and plurality of spaced dimples for receiving the detent of the bit selector.

Referring to FIGS. 1 and 6, along the closed end of the inside surface of bit cap 142, are a plurality of locking dimples 162, and through dimples 164. Any one of the locking dimples 162, and through dimples 164 are capable of receiving the detent 136 on the bit gate 134. The through dimples 164 are arranged one each, in register with through apertures 146 in the bit cap 142. Locking dimples 162 are positioned between through dimples 164. It is to be appreciated by the skilled practitioner that any number locking dimples 162, or through dimples 164, may be used without departing from the spirit of the present invention. Further, the number of locking and through dimples 162, 164 provided will vary depending upon the number of bit storage compartments desired. For example, one through dimple 164 may be provided for each bit channel 130, and at least one locking dimple 162 provided between each through dimple 164. In one embodiment, six bit channels 130 are provided with locking and through detents 162, 164 collectively spaced every 30 degrees. This results in six through dimples 164 (one through dimple 164 aligned with each bit channel 130), and six locking dimples 162, one locking dimple 162 spaced between each of the through dimples 164. To ensure a positive engagement of the detent 136 with the inside surface of bit cap 142, and more particularly the plurality of locking and through dimples 162, 164, a recess 126 is provided in the second portion or heel 128 of the driver body portion 115. A biasing spring 132 is positioned axially on the longitudinal axis L, in the recess 126, positioned to engage the bit gate 134, and maintain the bit gate 134 against the bit cap 142.

By turning the spring biased bit gate 134, a user can cause the gate aperture 133 in the bit gate 134 to align longitudinally with any one of the bit channels 130 in the body portion 115, and corresponding through aperture 146 in the bit cap 142. The detent 136 on the bit gate 134 is received by a through dimple 164 holding the gate aperture 133 into alignment allowing placement or removal of a bit 150 in the bit channel 130. In this position, all other bits 150 are locked into their respective bit channels 130 because the circular bit shield, or disk 140 blocks the through connection between bit channels 130, in the body portion 115, and the through apertures 146 in the bit cap 142. Likewise, turning the bit gate 134 so that gate aperture 133 is between bit channels 130 effectively locks all bit chambers. In this position, the detent 136 engages any one of the locking dimples 162, which is sufficient to cause the gate aperture 133 to substantially misalign with all of the bit channels 130, thus locking bits 150 in their respective bit channels 130.

Figure 4:
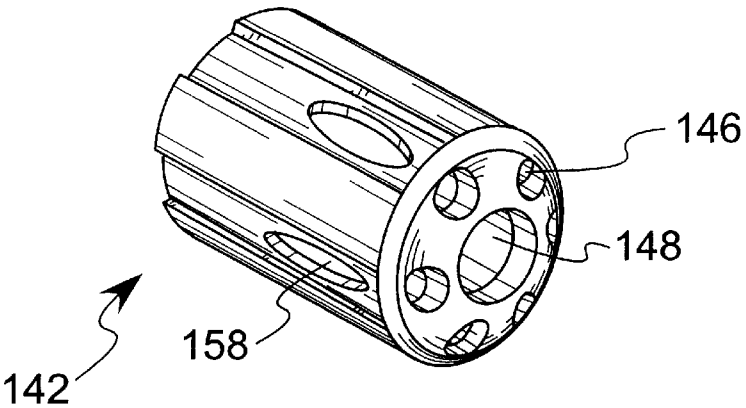
FIG. 4 is an isometric illustration of the bit cap for a driver illustrating an embodiment including a plurality of apertures on the cap end, and a plurality of apertures on the side surface for viewing bit tips.

While not required to practice the present invention, ease in selecting a driving bit 150 from the bit channels 130, can be realized where the driving bit tips 152, 154 are viewable. The through apertures 146 in the bit cap 142 are designed of such geometry that the apertures extend through the side portion of the bit cap 142, exposing a portion of the bit channel near the heel or second end 128 of the body portion 115. Referring to FIG. 4, alternatively, a second plurality of apertures, or tip portals 158 are provided along the surface of the side, or generally cylindrical portion of the bit cap 142 to expose a portion of the bit channel 130 near the second end or heel 128 of the body portion 115. Referring to FIG. 1, to allow the tip of driving bit 150 stored proximate to the nose or first end 116 of body portion 115 to be viewable, the body portion 115 includes raised surface areas 118 which meet and are juxtaposed with the open end circumference of the bit cap 142.

Figure 5:
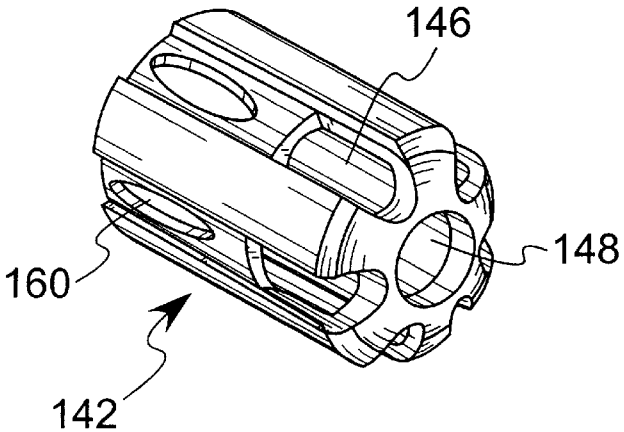
FIG.5 is an isometric illustration of the bit cap for a driver illustrating an embodiment including a plurality of apertures on the cap end, and a plurality of apertures on the side surface for viewing bit tips.

The plurality of bit channels 130 extend towards the nose or first end 116 a distance beyond the raised surface areas 118. Thus, with bit cap 142 slid over body portion 115 up to raised surface area 118, a window 120 is defined for exposing the tip 152 of bit 150 stored in the bit channel 130. Referring to FIG. 5, alternatively, where, for example, the bit channel is not outwardly open, or where it is not desired to incorporate tip window 120 into the body portion 115, the bit cap 142 can include apertures 160, positioned along the side surface in alignment with the driving bit tips 152 stored in bit channels 130. Of course, where the bit channels 130 are not outwardly open, an aperture (not shown) must extend through the body portion 115 exposing a portion of the bit channel proximate the nose or first end 116 of the body portion 115 positioned approximately where the tip portion 115 resides. In addition, or as an alternative to providing apertures, or tip portals 146, 158, 160, 120 for viewing driving bit tips 152, 154, the handle 106 can incorporate transparent material such as a clear plastic.

To ensure a positive engagement of the bit cap 142 over the body portion 115, the surface 124 of the body portion 115 includes a plurality of splines 122. The bit cap 142 includes complimentary spline channels 144, (shown in phantom lines) for receiving the splines 122 of the handle body 115 to ensure positive alignment of the body portion 115 to the bit cap 142. The splines 122 can be arranged in any suitable manner, depending upon requirements such as desired strength and expected torquing forces applied to the handle 106. An example of a suitable arrangement includes a plurality of splines 122 running generally longitudinally along the surfaces 124 separating each of the bit channels 130. Alternatively, the splines can reside on the inside surface of the bit cap 142, with the complimentary spline channels provided on the driver body surface 124.

In operation, a user grasps the bit selector 138 and rotates it to expose the desired bit channel 130. If the users wishes to insert a bit, the user simply drops the bit into the through aperture 146. The bit travels through the gate aperture 133 and into the respective bit channel 130 for storage. To remove a bit already in storage, the user turns the tool 100 such that the through aperture 146 is lower than its respective bit channel, and dumps the bit out into a hand, table or other surface. To subsequently lock the bit channels, the user grasps and rotates the bit selector 138 until the directional arrow or other indica 156 indicates that the gate aperture 133 is not in substantial alignment with any of the bit channels 130.

Having described the invention in detail and by reference to preferred embodiments thereof, it will be apparent that modifications and variations are possible without departing from the scope of the invention defined in the appended claims.

What is claimed is:

1. A driver body comprising:

a body portion having a first end and a second end;

a plurality of bit channels arrayed circumferentially about a longitudinal axis of said body portion, each of said plurality of bit channels open at said second end;

a bit cap positioned over said driver body and covering said second end, said bit cap having a bit selector port, and a plurality of through apertures aligned with said plurality of bit channels; and, a bit gate positioned between said bit cap and said body portion, juxtaposed with said second end, having a bit selector accessible through said bit selector port for selectively blocking alignment of said plurality of bit channels with said plurality of through apertures.

2. A driver body according to claim 1, wherein said bit gate further comprises a bit disk having a gating portion and a through portion, said bit disk being rotatable to align said through portion with said plurality of bit channels.

3. A driver body according to claim 2, wherein said through portion is adapted to align with no more than one of said plurality of bit channels.

4. A driver body according to claim 3, wherein said bit gate further comprises a signaling mechanism to identify alignment of said through portion of said bit gate with one of said plurality of bit channels.

5. A driver body according to claim 4, wherein said signaling mechanism comprises a detent on said bit disk and said bit cap further comprises a plurality of dimples for receiving said detent.

6. A driver body according to claim 1, wherein said bit selector further comprises a bit indicator to identify which one of said plurality of bit channels is selected.

7. A driver body according to claim 5, further comprising a spring positioned between said second end of said body portion and said bit gate for biasing said detent.

8. A driver body according to claim 7, wherein said second end further comprises a recess for receiving said spring.

9. A driver body according to claim 1, further comprising a plurality of bits, each of said plurality of bits having a first tip, a bit shaft, and a second tip, one of said plurality of bits insertable into any one of said plurality of bit channels.

10. A driver body according to claim 9, wherein said first tip of each of said plurality of bits are viewable through said driver body.

11. A driver body according to claim 9, wherein said second tip of each of said plurality of bits are viewable through said driver body.

12. A driver body according to claim 9, wherein said second tip of each of said plurality of bits are viewable through said bit cap.

13. A driver body according to claim 9, wherein both said first tip and said second tip of each of said plurality of bits are viewable through said driver body.

14. A driver body according to claim 9, wherein said bit cap extends over said body portion such that at least a portion of said shaft of each of said plurality of bits is covered by said bit cap.

15. A driver body according to claim 9, wherein said bit cap contains a plurality of tip portals aligned such that said second tip of each of said plurality of bits are viewable through said bit cap.

16. A driver body according to claim 9, wherein said bit cap contains a plurality of tip portals aligned such that said first tip of each of said plurality of bits are viewable through said bit cap.

17. A driver body according to claim 1, wherein said bit channels are outwardly open along said body portion.

18. A driver body according to claim 1, wherein said body portion and said bit cap are mated by a plurality of splines, and a complimentary plurality of spline channels for receiving said plurality of splines.

19. A driver body according to claim 18, wherein said plurality of splines protrude from said body portion, and said complimentary plurality of spline channels extend along said bit cap.

20. A driver body according to claim 18, wherein said plurality of splines protrude from said bit cap, and said complimentary plurality of spline channels extend along said body portion.

21. A driver body according to claim 17, wherein said body portion further comprises six splines, each equally spaced and centered between adjacent bit channels.

22. A driver body according to claim 1, wherein said body portion comprises a one piece molded body.

23. A driver body according to claim 1, wherein said plurality of bit channels comprises six, equally spaced bit channels.

24. A tool handle comprising:

a driver body having a body surface, a first end and a second end;

said second end having a second end periphery;

a plurality of bit channels extending through said driver body, open at said second end periphery;

a plurality of splines extending along said body surface;

a bit cap having an inside surface, and a plurality of through apertures, said bit cap secured to said driver body and covering at least said second end of said driver body;

said inside surface of said bit cap having a plurality of spline channels arranged to receive said plurality of splines; and, said plurality of through apertures proportioned and arranged to align with said plurality of bit channels.

25. A tool handle according to claim 24, further comprising a bit gate positioned between said second end periphery of said driver body and said bit cap, said bit gate rotatable from a locked position wherein said plurality of bit channels are partitioned from said plurality of through apertures, to an unlocked position wherein one of said plurality of bit channels is open to a corresponding one of said plurality of through apertures.

26. A tool handle according to claim 25, wherein said bit gate consists of a generally circular disk and includes a gate aperture adapted to cooperate between a single one of said bit channels, said gate aperture, and one of said plurality of through apertures in said bit cap.

27. A tool handle according to claim 25, wherein said bit cap further comprises a bit gate port and said bit gate further comprises a knob extending through said bit gate port for transitioning said bit gate from said locked position to said unlocked position.

28. A tool handle according to claim 25, further comprising a spring positioned along said second end periphery and engaged with said bit gate.

29. A tool handle according to claim 28, wherein said second end periphery further comprises a recess for seating said spring.

30. A tool handle according to claim 25, wherein said bit gate further comprises a signaling mechanism to identify whether said bit gate is in said locked or said unlocked position.

31. A tool handle according to claim 30, wherein said signaling mechanism comprises a detent.

32. A tool handle according to claim 24, wherein said plurality of bit channels are outwardly open grooves.

33. A tool handle according to claim 32, wherein said plurality of splines are arranged between said outwardly open grooves.

34. A tool handle according to claim 24, wherein said plurality of bit channels comprises six, equally spaced bit channels.

35. A tool handle according to claim 24, wherein said plurality of splines comprises six splines, each equally spaced and centered between adjacent bit channels.

36. A hand tool comprising:

handle having:

a generally cylindrical body portion having a body portion periphery;

a plurality of grooves outwardly opened and extending longitudinally along said body portion periphery; and a plurality of splines protruding from said body portion periphery;

an elongate shank having a first end portion and a second end portion;

said second end portion of said elongate shank secured along a common longitudinal axis with said handle;

a socket secured to said first end portion of said elongate shank for receiving a driving bit; and a handle cap having an open handle cap first end, a partially closed handle cap second end, a handle cap inside surface;

a plurality of spline channels on said inside surface of said handle cap; and a plurality of through apertures along said handle cap second end;

wherein said handle is insertable into said handle cap such that said plurality of splines are received in said plurality of spline channels, and said plurality of through apertures align longitudinally with said plurality of grooves.

37. A hand tool according to claim 36, further comprising a bit gate positioned between said handle and said handle cap, for selectively blocking said plurality of grooves from said plurality of through apertures.

38. A hand tool according to claim 37, wherein said bit gate further comprises a disk having a single gate aperture, said gate aperture rotatable to align a single one of said plurality of grooves with a single one of said plurality of through apertures.

39. A hand tool according to claim 37, wherein said bit gate includes a signaling mechanism to identify when alignment occurs.

40. A hand tool according to claim 37, wherein said bit gate further comprises a selector to identify which one of said plurality of grooves is selected.

41. A hand tool according to claim 36, wherein said plurality of through apertures include opening portions dimensioned to allow view of a heel portion of said plurality of grooves.

42. A hand tool according to claim 36, wherein said plurality of grooves extend longitudinally a distance greater than a portion of said handle caped by said handle cap to allow view of a nose portion of said plurality of grooves.

43. A tool handle according to claim 36, further comprising a ratchet.

* * * * *